US005775087A

United States Patent [19]

Goineau

[11] Patent Number: 5,775,087

[45] Date of Patent: Jul. 7, 1998

[54] BALANCED COLLAGE YARN

[75] Inventor: Andre'M. Goineau, Williamston, S.C.

[73] Assignee: Milliken Research Corporation, Spartanburg, S.C.

[21] Appl. No.: 851,960

[22] Filed: May 6, 1997

[51] Int. Cl.[6] ..... D01H 13/02

[52] U.S. Cl. ..... 57/908; 57/90; 57/350; 57/351

[58] Field of Search ..... 57/244, 245, 247, 57/293, 333, 90, 350, 351, 908; 28/271, 258

[56] References Cited

U.S. PATENT DOCUMENTS

| | | | |
|---|---|---|---|
| 3,824,776 | 7/1974 | London, Jr. | 57/140 J |
| 3,911,655 | 10/1975 | London, Jr. et al. | 57/34 HS |
| 3,972,174 | 8/1976 | London, Jr. et al. | 57/140 J |
| 4,016,715 | 4/1977 | London, Jr. | 57/157 TS |
| 4,055,039 | 10/1977 | Movshovich et al. | 57/34 AT |
| 4,068,459 | 1/1978 | Movshovich et al. | 57/156 |
| 4,069,565 | 1/1978 | Negishi et al. | 28/274 |
| 4,070,815 | 1/1978 | Negishi et al. | 57/140 J |
| 4,084,400 | 4/1978 | Movshovich et al. | 57/156 |
| 4,134,252 | 1/1979 | Otaki et al. | 57/284 |
| 4,147,020 | 4/1979 | Oakes | 57/908 |
| 4,218,869 | 8/1980 | Newton | 57/908 |
| 4,341,063 | 7/1982 | Southerlin et al. | 28/258 |
| 4,437,301 | 3/1984 | Eschenbach et al. | 57/908 |
| 4,467,594 | 8/1984 | Eschenbach et al. | 28/271 |
| 5,107,671 | 4/1992 | Morihashi et al. | 57/328 |
| 5,170,619 | 12/1992 | Noda | 57/328 |
| 5,317,791 | 6/1994 | Adam | 28/258 |
| 5,379,501 | 1/1995 | Goineau | 28/271 |
| 5,613,285 | 3/1997 | Chester et al. | 28/258 |

FOREIGN PATENT DOCUMENTS

| | | | |
|---|---|---|---|
| 1029097 | 4/1964 | United Kingdom | 28/258 |

*Primary Examiner*—William Stryjewski
*Attorney, Agent, or Firm*—Terry T. Moyer; Earle R. Marden

[57] ABSTRACT

Process of manufacturing a collage yarn from at least two different colored synthetic multifilament yarn. At least two bobbins of different colored multifilament, synthetic yarn, is supplied to commingling air jet. A true twist is provided to each of the yarns as they are being supplied to the commingling jets. Compressed air is supplied to the commingling jets to commingle the yarns into a collage yarn and then the collage yarn is taken up by a take-up roll.

8 Claims, 1 Drawing Sheet

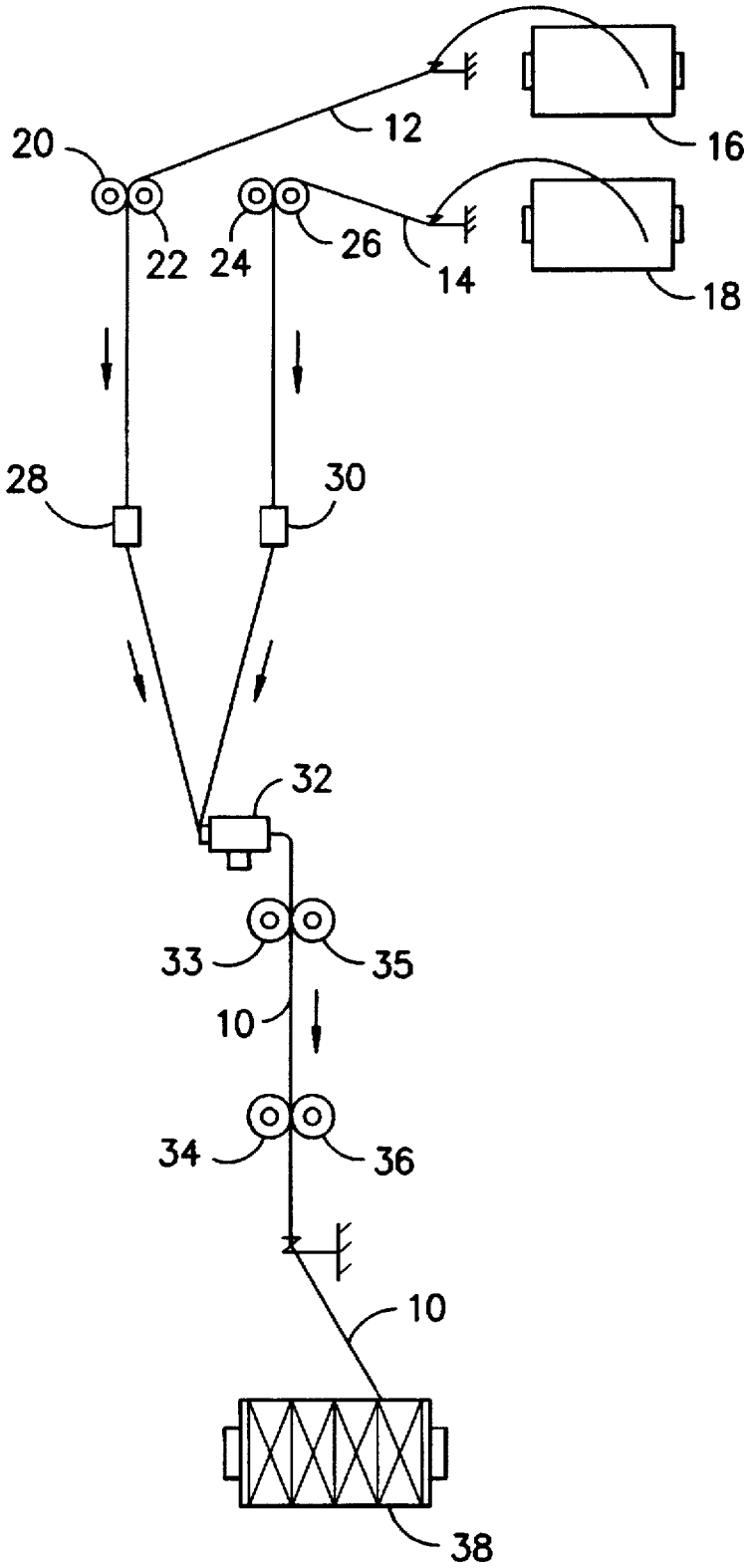
FIG. —1—

BALANCED COLLAGE YARN

BACKGROUND OF THE INVENTION

This invention relates to a method to produce a balanced collage yarn from two or more package dyed yarns which does not produce streaks when manufactured into cut pile plush fabrics.

The collage process consists of assembling two or more package-dyed yarns. It is done on machines which employ commingling air jets. The cut pile plush fabrics made from such collaged yarns have a tendency to develop streaks, some of which are due to one of the components of the assembled yarn to be more visible occasionally than it should. This fabric defect is also sometimes called "phasing". To eliminate this type of streak, we have developed a novel process where we use a zero net twist approach, but we submit each ply to a continuous, non-alternating, either S or Z twist action prior to the conventional commingling in the same overfeed zone.

It is therefore an object of the invention to provide a method to produce a collage yarn which, when woven or knit into a fabric to produce a plush pile fabric, does not have the fabric defect known as "phasing".

For the purposes of this invention, the term collage yarn refers to a yarn which has been produced from yarns, preferably pre-dyed yarns, which have different colors and can have the same or different yarn characteristics.

BRIEF DESCRIPTION OF THE DRAWINGS

FIG. 1 is a schematic representation of the method to produce the collage yarn.

DESCRIPTION OF THE DRAWINGS

Looking now to the drawings, the preferred embodiment of the invention will be explained wherein a collage yarn 10 is produced from package dyed polyester yarns 12 and 14 supplied from the respective bobbins 16 and 18. The yarns 12 and 14 are both 250 denier, 100 filament polyester yarns but of different colors to produce the desired collage yarn 10.

In operation the yarns 12 and 14 are delivered by the delivery rolls 20, 22, 24 and 26 running at a speed of 1716 RPM through the air twister jets 28 and 30 and merged as they pass into the commingling air jet 32. The air jets 28, 30 and 32 each operate at a pressure of 60 PSI with jet 28 providing an "S" twist to the yarn 12 and the jet 30 providing a "Z" twist to the yarn 14. This "S" and "Z" twist arrangement is preferred but is not necessary so long as the jets 28 and 30 are providing a twist in the twistless yarns 12 and 14 prior to the commingling of the yarns in the jet 32 to form the collage yarn 10.

To enhance the formation of the collage yarn in the jet 32, the rolls 33 and 35 are running at a speed of 1698 RPM to provide about a 1% overfeed of the yarns 12 and 14 through the commingling jet 32. From the commingling jet, the collage yarn 10 is delivered to the take-up roll 38 by the driven rolls 34 and 36 running at a speed of 1681 RPM whereat it is taken up for use at a knitting machine or a loom. This process provides a collage yarn which is thoroughly commingled so that one yarn does not periodically be more pronounced than the other yarn so that when it is used on a knitting machine or a loom to produce a cut plush fabric, streaks do not appear in the fabric.

Although the preferred embodiment of the invention has been described in detail, it is contemplated that many changes may be made without departing from the scope or spirit of the invention and it is, therefore, desired that the invention be limited only the claims.

What is claimed is:

1. A process to provide a collage yarn from at least two different colored yarns comprising the steps of: providing at least two bobbins of different colored multifilament, synthetic yarn, supplying the yarn from said bobbins to a commingling air jet, providing a twist in each of said yarns as they are being supplied to said commingling air jet, supplying air under pressure into said commingling air jet to commingle said yarns into a collage yarn and supplying said collage to a take-up roll.

2. The process of claim 1 wherein said yarns are slightly overfed to said commingling air jet.

3. The process of claim 2 wherein said yarns are 250 denier, 100 filament.

4. The process of claim 3 wherein one of said yarns is given a "Z" twist and the other of said yarns is given an "S" twist.

5. The process of claim 4 wherein said yarns are polyester.

6. The process of claim 1 wherein said yarns are given a "Z" twist or an "S" twist.

7. The process of claim 6 wherein said yarns are slightly overfed to said commingling air jet.

8. The process of claim 7 wherein said yarn is 250 denier, 100 filament.

* * * * *